US005775382A

United States Patent [19]

Chu

[11] Patent Number: 5,775,382

[45] Date of Patent: Jul. 7, 1998

[54] PROCESS FOR MANUFACTURING TEXTILE

[76] Inventor: Wilson Chu, Annapolis Tower, 43 Annapolis St., Greenhills St., San Juan, Metro Manila, Philippines

[21] Appl. No.: 578,877

[22] Filed: Dec. 22, 1995

[51] Int. Cl.[6] ..... D03D 15/00

[52] U.S. Cl. ..... 139/420 R; 442/211; 139/426 R; 8/151.2

[58] Field of Search ..... 8/151.2; 139/420 R, 139/383 R, 426 R; 428/225; 28/167; 442/211

[56] References Cited

U.S. PATENT DOCUMENTS

| | | | |
|---|---|---|---|
| 4,302,929 | 12/1981 | Bauer et al. | 57/247 |
| 4,343,334 | 8/1982 | Schulze et al. | 139/420 R |
| 4,924,545 | 5/1990 | Machau | 8/151 |
| 5,025,537 | 6/1991 | Green | 26/18.5 |
| 5,034,016 | 7/1991 | Koshida et al. | 8/653 |
| 5,234,464 | 8/1993 | Zimmer et al. | 8/543 |
| 5,396,688 | 3/1995 | Brown et al. | 26/28 |
| 5,419,952 | 5/1995 | Brown et al. | 428/255 |

*Primary Examiner*—Andy Falik
*Attorney, Agent, or Firm*—Brinks Hofer Gilson & Lione

[57] ABSTRACT

A method of manufacturing a fabric so that it has a stony-washed appearance. The method includes the steps of: (1) providing a special hairy warp yarn, (2) dying the special hairy warp yarn, and (3) weaving the dyed special hairy warp yarn with a natural weft yarn so as to produce a fabric having a stony-washed appearance.

8 Claims, 1 Drawing Sheet

PROCESS FOR MANUFACTURING TEXTILE

Applicant claims, under 35 U.S.C. § 119, the benefit of priority of the filing date of Dec. 26, 1994, of a Philippine application, Ser. No. 49697, filed on the aforementioned date, the entire contents of which are incorporated herein by reference.

BACKGROUND OF THE INVENTION

1. Technical Field

This invention relates to a process for manufacturing textile that uses a special hairy yarn that will produce a textile having a stone-washed effect (as shown) on the surface thereon.

2. Background Art

FIG. 1 shows a piece of regular denim which is manufactured by dying a warp yarn in indigo, blue or sulfur, and weaving it with natural weft yarn. The regular denim does not have a stone-washed appearance. Heretofore, in attaining a fabric, particularly denims, that would have a special kind of surface like a "stone-washed" surface and the like, the manufacturing process used a special mercerizing process to make the washed effect on the fabric.

It is therefore the object of the present invention to introduce a process that will make the surface of the denim have a washed effect without going into the process of garment washing.

SUMMARY OF THE INVENTION

The present invention pertains to a method of manufacturing a fabric so that it has a stony-washed appearance. The method includes the steps of: (1) providing a special hairy warp yarn, (2) dying the special hairy warp yarn, and (3) weaving the dyed special hairy warp yarn with a natural weft yarn so as to produce a fabric having a stony-washed appearance.

Another aspect of the present invention involves a fabric made by the process of: (1) providing a special hairy warp yarn, (2) dying the special hairy warp yarn, and (3) weaving the dyed special hairy warp yarn with a natural weft yarn so as to produce a fabric having a stony-washed appearance.

The above-described aspects of the present invention provide for a fabric that already has a stone-washed look when made.

The foregoing features and advantages of the present invention will be further understood upon consideration of the following detailed description of the invention taken in conjunction with the accompanying drawings, in which:

DESCRIPTION OF THE PREFERRED EMBODIMENT.

Figure 1:
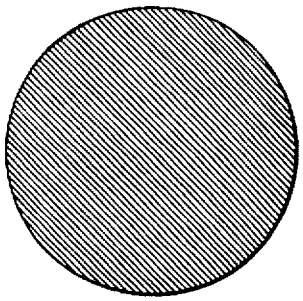
FIG. 1 PRIOR ART
FIG. 1 shows a top view of a regular piece of denim made by a prior known process.
Figure 2:
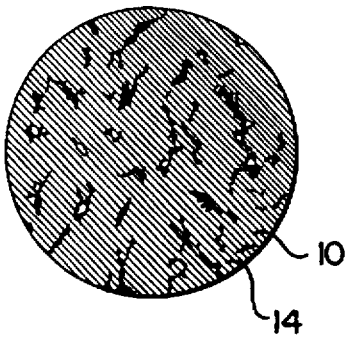
FIG. 2 shows a top view of a piece of denim that has been manufactured according to the present invention.
Figure 3:
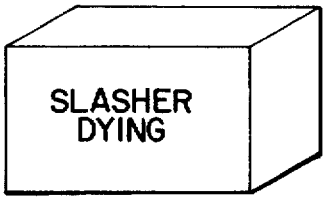
FIG. 3 schematically shows a slasher dying machine.
Figure 4:
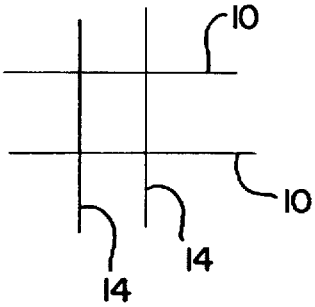
FIG. 4 schematically shows hairy warp yarns and natural weft yarns woven together according to the present invention.

FIG. 2 shows a fabric, such as a denim material, made by a process according to the present invention. That process involves starting with a special hairy warp yarn. An example of such a special hairy warp yarn is disclosed in U.S. Pat. No. 4,302,929, whose entire contents are incorporated herein by reference. The special hairy warp yarn 10 which is schematically shown in FIG. 2 as a plurality of diagonal lines is then dyed. The dying step involves a special mercerizing process which uses a slasher dying machine 12 which is schematically shown in FIG. 3 as a box. An example of such a special mercerizing process is disclosed in U.S. Pat. No. 4,924,545, whose entire contents are incorporated herein by reference. An example of how the mercerizing process is done in the dying machine is disclosed in U.S. Pat. No. 5,234,464, whose entire contents are incorporated herein by reference. Next, the dyed special hairy warp yarn is woven with a natural weft yarn 14 which is schematically shown in FIG. 2 as a plurality of diagonal lines so as to produce a textile fabric having a stony-washed appearance on its surface as shown in FIG. 2. As shown schematically in FIG. 4, the natural weft yarns 14 are conventionally represented as orthogonal to the hairy yarns warp 10. Thus, a stone-washed fabric is produced without undergoing the garment washing process.

The foregoing description is provided to illustrate the invention, and is not to be construed as a limitation. Numerous additions, substitutions and other changes can be made to the invention without departing from its scope as set forth in the appended claims.

I claim:

1. A method of manufacturing a fabric so that it has a stony-washed appearance, the method comprising the steps of:

providing a hairy warp yarn that has not been stone-washed;

dying said hairy warp yarn; and weaving said dyed hairy warp yarn with a natural weft yarn that has not been stonewashed so as to produce said fabric having a stony-washed appearance during the weaving process.

2. The method of claim 1, wherein said dying step comprises using a mercerizing process.

3. The method of claim 2, wherein said mercerizing process involves using a slasher dying machine.

4. A fabric having a stony-washed appearance made by the process of claim 1.

5. The fabric of claim 4, wherein said fabric is a denim material.

6. A method of manufacturing a fabric so that it has a stony-washed appearance, the method consisting essentially of the steps of:

providing a hairy warp yarn that has not been stone-washed;

dying said hairy warp yarn by using a mercurizing process that involves using a slasher dying machine; and weaving said dyed hairy warp yarn with a natural weft yarn that has not been stonewashed so as to produce said fabric having a stony-washed appearance during the weaving process.

7. A fabric having a stony-washed appearance made by the process of claim 6.

8. The fabric of claim 7, wherein said fabric is a denim material.

* * * * *

UNITED STATES PATENT AND TRADEMARK OFFICE

CERTIFICATE OF CORRECTION

PATENT NO. : 5,775,382

DATED : July 7, 1998

INVENTOR(S) : Wilson Chu

It is certified that error appears in the above-identified patent and that said Letters Patent is hereby corrected as shown below:

In claim 6, line 6, please change "mercurizing" to --mercerizing--.

Signed and Sealed this

Tenth Day of April, 2001

*Attest:*

Nicholas P. Godici

NICHOLAS P. GODICI

*Attesting Officer*

*Acting Director of the United States Patent and Trademark Office*